US005749185A

United States Patent [19]

Sorkin

[11] Patent Number: 5,749,185

[45] Date of Patent: May 12, 1998

[54] METHOD AND APPARATUS FOR AN INTERMEDIATE ANCHORAGE OF A POST-TENSION SYSTEM

[76] Inventor: Felix L. Sorkin, P.O. Box 1503, Stafford, Tex. 77477

[21] Appl. No.: 638,973

[22] Filed: Apr. 25, 1996

[51] Int. Cl.[6] ..... E04C 5/12

[52] U.S. Cl. ..... 52/223.13; 52/223.6; 24/122.6; 24/459; 24/464

[58] Field of Search ..... 52/223.6, 223.13, 52/223.14; 174/92, 91; 24/459, 464, 122.6

[56] References Cited

U.S. PATENT DOCUMENTS

| | | | |
|---|---|---|---|
| 4,388,488 | 6/1983 | Wlcek et al. | 174/92 |
| 4,557,007 | 12/1985 | Daiguji et al. | 24/122.6 X |
| 4,612,680 | 9/1986 | Daiguji | 52/223.14 X |
| 4,773,198 | 9/1988 | Reinhardt | 52/223.13 |
| 4,821,474 | 4/1989 | Rodriguez | 52/223.13 |
| 4,878,327 | 11/1989 | Nützel et al. | 52/223.13 |
| 4,918,887 | 4/1990 | Davis et al. | 52/223.13 |
| 4,928,451 | 5/1990 | Reigstad et al. | 52/223.13 |
| 5,072,558 | 12/1991 | Sorkin et al. . | |
| 5,079,879 | 1/1992 | Rodriguez | 52/223.13 |
| 5,271,199 | 12/1993 | Northern | 52/223.13 |
| 5,479,671 | 1/1996 | Stubler et al. | 52/233.14 X |
| 5,502,281 | 3/1996 | Schoelling et al. | 174/92 |

FOREIGN PATENT DOCUMENTS

| | | | |
|---|---|---|---|
| 2820171 | 11/1979 | Germany | 174/92 |
| 3345932 | 6/1985 | Germany | 174/92 |

OTHER PUBLICATIONS

VSL Corporation, VSL Post-Tensioning Systems, Mar. 1994, pp. 24–27.

*Primary Examiner*—Carl D. Friedman
*Assistant Examiner*—Laura A. Callo

[57] ABSTRACT

An intermediate anchorage for post-tension system including an anchor member having an interior passageway extending therethrough, a tendon extending through the interior passageway and having a sheathed and an unsheathed portion extending outwardly from one side of the anchor member, and a split tubular member received at one end by the anchor member and extending over the sheathed portion of the tendon. The split tubular member has another end extending over the sheathed portion of the tendon. The split tubular member has a first longitudinal edge and a second longitudinal edge extending therealong. The longitudinal edges are separable for a distance greater than a diameter of the tendon so as to allow the tendon to be asked into an interior of the tubular member. A seal is formed between the longitudinal edges so as to prevent liquid intrusion into the interior of the tubular member.

18 Claims, 2 Drawing Sheets

METHOD AND APPARATUS FOR AN INTERMEDIATE ANCHORAGE OF A POST-TENSION SYSTEM

TECHNICAL FIELD

The present invention relates to post-tensioning systems. More particularly, the present invention relates to post-tensioning systems having intermediate anchorages. Furthermore, the present invention relates to sealing devices for preventing liquid intrusion into the exposed sections of tendon in the post-tension system.

BACKGROUND ART

For many years, the design of concrete structures imitated the typical steel design of column, girder and beam. With technological advances in structural concrete, however, its own form began to evolve. Concrete has the advantages of lower cost than steel, of not requiring fireproofing, and of its plasticity, a quality that lends itself to free flowing or boldly massive architectural concepts. On the other hand, structural concrete, though quite capable of carrying almost any compressive load, is weak in carrying significant tensile loads. It becomes necessary, therefore, to add steel bars, called reinforcements, to concrete, thus allowing the concrete to carry the compressive forces and the steel to carry the tensile forces.

Structures of reinforced concrete may be constructed with load-bearing walls, but this method does not use the full potentialities of the concrete. The skeleton frame, in which the floors and roofs rest directly on exterior and interior reinforced-concrete columns, has proven to be most economic and popular. Reinforced-concrete framing is seemingly a quite simple form of construction. First, wood or steel forms are constructed in the sizes, positions, and shapes called for by engineering and design requirements. The steel reinforcing is then placed and held in position by wires at its intersections. Devices known as chairs and spacers are used to keep the reinforcing bars apart and raised off the form work. The size and number of the steel bars depends completely upon the imposed loads and the need to transfer these loads evenly throughout the building and down to the foundation. After the reinforcing is set in place, the concrete, a mixture of water, cement, sand, and stone or aggregate, of proportions calculated to produce the required strength, is placed, care being taken to prevent voids or honeycombs.

One of the simplest designs in concrete frames is the beam-and-slab. This system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be utilized over and over for the same shape. The system, therefore, produces an economically viable structure. With the development of flat-slab construction, exposed beams can be eliminated. In this system, reinforcing bars are projected at right angles and in two directions from every column supporting flat slabs spanning twelve or fifteen feet in both directions.

Reinforced concrete reaches its highest potentialities when it is used in pre-stressed or post-tensioned members. Spans as great as one hundred feet can be attained in members as deep as three feet for roof loads. The basic principle is simple. In pre-stressing, reinforcing rods of high tensile strength wires are stretched to a certain determined limit and then high-strength concrete is placed around them.

When the concrete has set, it holds the steel in a tight grip, preventing slippage or sagging. Post-tensioning follows the same principle, but the reinforcing tendon, usually a steel cable, is held loosely in place while the concrete is placed around it. The reinforcing tendon is then stretched by hydraulic jacks and securely anchored into place. Pre-stressing is done with individual members in the shop and post-tensioning as part of the structure on the site.

In a typical tendon tensioning anchor assembly used in such post-tensioning operations, there are provided anchors for anchoring the ends of the cables suspended therebetween. In the course of tensioning the cable in a concrete structure, a hydraulic jack or the like is releasably attached to one of the exposed ends of each cable for applying a predetermined amount of tension to the tendon, which extends through the anchor. When the desired amount of tension is applied to the cable, wedges, threaded nuts, or the like, are used to capture the cable at the anchor plate and, as the jack is removed from the tendon, to prevent its relaxation and hold it in its stressed condition.

There are many post-tension systems employing intermediate anchorages where the length of the slab is too long to tension with a single anchor. In these systems, the intermediate anchor is interposed between a live end and a dead end anchor. In the construction of such intermediate anchorage systems, the tendon extends for a desired length to the intermediate anchor. A portion of the sheathing is removed in the vicinity of the intermediate anchor. The intermediate anchor is installed onto a form board in accordance with conventional practice. The unsheathed portion of the tendon is received by a tensioning apparatus such that the tendon is stressed in the area between the dead end anchor and the intermediate anchor. After stressing the tendon, concrete is poured over the exterior of the sheathed tendon and over the dead end anchor and intermediate anchor. The remaining portion of the tendon extends from the intermediate anchor to either another intermediate anchorage or to the live end anchor. Intermediate anchorage systems are employed whenever the slab is so long that a single live anchor extending to a single dead end anchor is inadequate. For example, two intermediate anchorages would be used for slabs having a length of approximately 300 feet.

A problem that affects many of the intermediate anchorage systems is the inability to effectively prevent liquid intrusion into the unsheathed portion of the tendon. Normally, the unsheathed portion will extend outwardly, for a distance, from the intermediate anchor in the direction toward the dead end anchor. Additionally, another unsheathed portion will extend outwardly at the intermediate anchor toward the live end anchor. In normal practice with a single live anchor and without intermediate anchors, a liquid-tight tubular member is placed onto an end of the anchor so as to cover the unsheathed portion of the tendon. This is relatively easy to accomplish since the length of the tendon is minimal at the live end. However, it is a considerable burden to attempt to slide such a tubular member along the entire length of the tendon so as to form the liquid-tight seal at the intermediate anchorage. In normal practice, tape, or other corrosion protection materials, are applied to the exposed portion of the tendon adjacent the intermediate anchorage. Extensive practice with this technique has shown that it is generally ineffective for preventing liquid intrusion into the interior of the tendon or into the interior of the intermediate anchorage. As such, a great need has developed in which to protect the exposed areas of the tendon adjacent the intermediate anchorage.

It is an object of the present invention to provide an intermediate anchorage for a post-tension system which forms an effective seal over the exposed portions of the tendon at the intermediate anchorage.

It is a further object of the present invention to provide a sealing apparatus for attachment to the intermediate anchorage which prevents liquid intrusion.

It is a further object of the present invention to provide a sealing apparatus which is easy to install and easy to use.

It is a further object of the present invention to provide a sealing apparatus which is easy to manufacture and relatively inexpensive.

These and other objects and advantages of the present invention will become apparent from a reading of the attached specification and appended claims.

SUMMARY OF THE INVENTION

The present invention is an intermediate anchorage for a post-tension system that comprises an anchor member having an interior passageway extending therethrough, a tendon extending through the interior passageway of the anchor, and a split tubular member received at one end by the anchor member and extending over an unsheathed portion of the tendon. The split tubular member has another end extending over the sheathed portion of the tendon. The split tubular member has a pair of longitudinal edges in overlapping relationship. A seal is formed between the longitudinal edges so as to prevent liquid intrusion therethrough.

The anchor member has an opening formed at one end. The tubular member extends into this opening. The tubular member includes a first annular seal formed at the end received by the opening. This first annular seal forms a liquid-tight seal between an inner wall of the tubular member and an outer surface of the unsheathed portion of the tendon. A second annular seal is formed adjacent the opposite end of the tubular member so as to form a liquid-tight seal between an inner wall of the tubular member and an outer surface of the sheathed portion of the tendon.

The split tubular member has longitudinal edges which are separable for a distance greater than the diameter of the tendon. As such, the tendon can pass between the longitudinal edges so as to enter the interior of the split tubular member. The seal is formed of an insert protrusion extending radially inwardly adjacent one of the longitudinal edges, and a receptacle extending radially outwardly of an exterior surface of the tubular member. The insert protrusion is received in liquid-tight relationship by the receptacle. The insert protrusion and the receptacle extend longitudinally along an entire length of the tubular member. Alternatively, the insert protrusion can extend radially outwardly of the exterior surface of the tubular member, and the receptacle can be formed radially inwardly adjacent one of the longitudinal edges.

In the present invention, a second tubular member can be affixed to an opposite side of the anchor member and extend over over another unsheathed portion of the tendon. The second tubular member has another end which extends over another sheathed portion of the tendon. This second tubular member also is a split tubular member having longitudinal edges in overlapping relationship. A seal is formed between the longitudinal edges of the second split tubular member. The longitudinal edges of the second tubular member are separable by a distance not less than a diameter of the tendon. The second tubular member is affixed to a tubular extension formed in the anchor member and extending outwardly therefrom. An annular seal is affixed to the opposite end of the second tubular member so as to form a liquid-tight seal between the sheathed portion of the tendon and the inner wall of the second tubular member.

The present invention is also a method of post-tensioning an intermediate anchorage which includes the steps of: (1) extending a tendon through an interior passageway of the intermediate anchorage; (2) stressing the tendon such that the unsheathed portion of the tendon extends outwardly of one side of the anchorage; (3) separating the longitudinal edges of a split tubular member by a distance greater than a diameter of the tendon; (4) passing the tendon between the separated longitudinal edges such that the unsheathed portion of the tendon resides on an interior of the tubular member; and (5) sealing the split tubular member between the longitudinal edges.

DETAILED DESCRIPTION OF THE INVENTION

Figure 1:
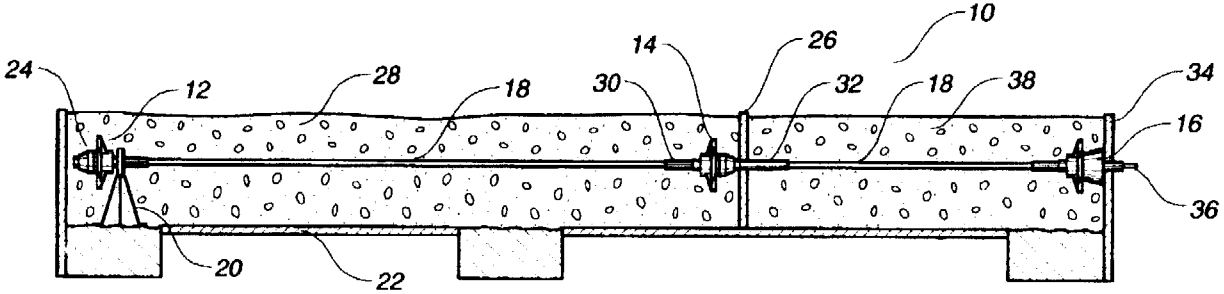
FIG. 1 is a side elevational view of a post-tensioning system employing the intermediate anchorage of the present invention.

In FIG. 1, there is shown at 10 the post-tensioning system anchorage system in accordance with the teachings of the present invention. The post-tensioning system 10 includes a dead end anchor 12, an intermediate anchor 14 and a live end anchor 16. A tendon 18 extends from the dead end anchor 12 through the intermediate anchor 14 and into the live end anchor 16. The dead end anchor 12 is supported on a chair 20 above a slab 22 for a desired distance. The end 24 of the tendon 18 is fixed into the dead end anchor 12. The tendon 18 is a sheathed tendon 18 which extends from the dead end anchor 12 through the intermediate anchor 14. The intermediate anchor 14 is mounted on a frame 26 so as to support the intermediate anchor 14 a desired distance above the floor or slab 22.

The tendon 18 is initially tensioned in the area between the intermediate anchor 14 and the dead end anchor 12. Suitable wedges are applied into the interior passageway of the intermediate anchor 14 so as to retain the tendon 18 in its stressed condition. Concrete 28 can then be poured over the stressed tendon 18. Prior to the pouring of the concrete 28, a sealing member 30 is affixed to an end of the anchor 14 on an opposite side of the anchor 14 from the frame 26. Additionally, another tubular corrosion protection member 32 is affixed to the anchor 14 on an opposite side of the frame 26. The tubular corrosion protection 32 over the exposed unsheathed portion of the tendon 18 which extends outwardly into the area between the intermediate anchorage 14 and the live end anchorage 16.

The live end anchor 16 is mounted on another frame 34 so as to support the live end anchor 16 a desired distance above the floor or slab 22. The end 36 of the tendon 18 will extend outwardly on an opposite side of the frame 34. The end 36 of the tendon 18 can then be stressed so as to tension the tendon 18 in the area between the intermediate anchor 14 and the live end anchor 16. In normal practice, this will cause the exposed portion of the tendon 18 and the area of the intermediate anchor 14 to extend further outwardly of the intermediate anchor 14. As such, the tubular corrosion protection member 32 should have a sufficient length so as to accommodate the tensioning of the tendon 18. Concrete 38 is then poured into the area between the intermediate anchor 14 and the live end anchor 16.

Figure 2:
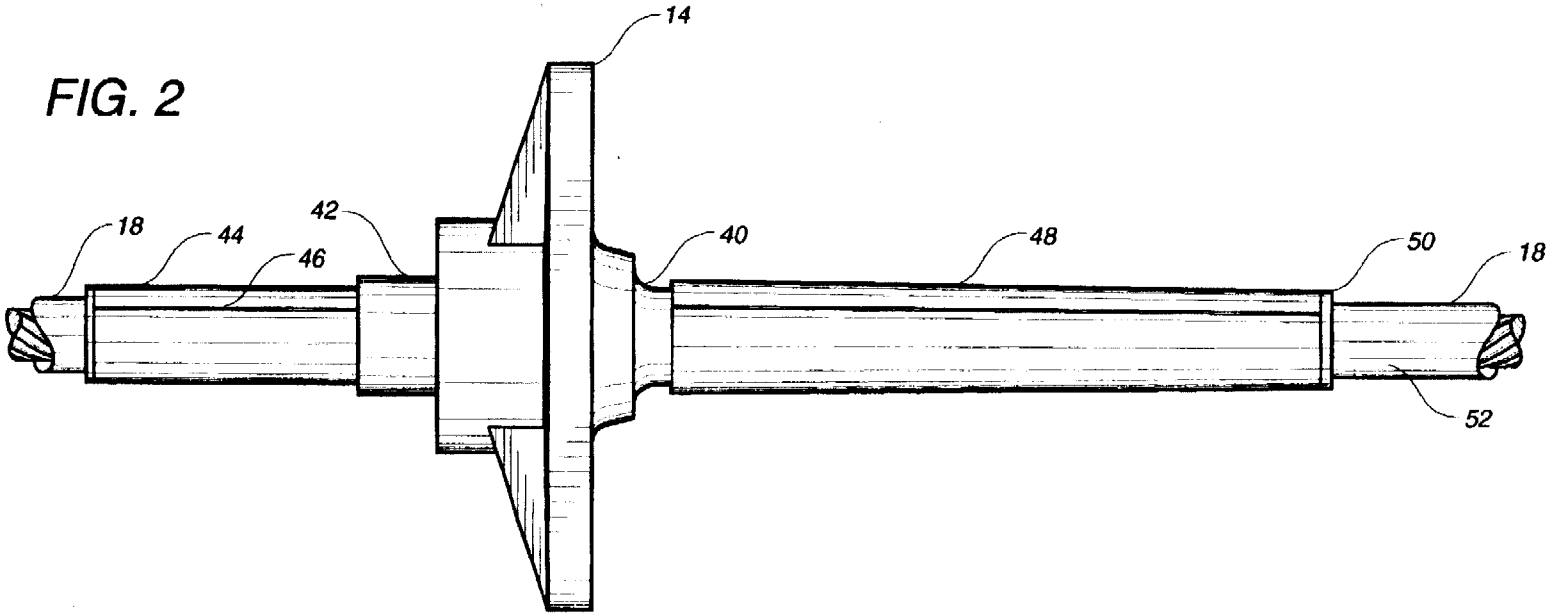
FIG. 2 is a plan view of the intermediate anchorage system of the present invention.

FIG. 2 shows the configuration of the intermediate anchor 14 as used in the system of the present invention. The anchor 14 is an encapsulated anchor having a tubular extension 40 extending outwardly from one side of the anchor 14 and a tubular opening 42 extending outwardly from an opposite side of the anchor 14. As can be seen, the tendon 18 extends through the interior passageway of the anchor 14 and through the tubular extension 40 and the tubular opening 42. Importantly, in the present invention, a first split tubular member 44 extends over the exposed unsheathed portion of the tendon 18. An end of the first split tubular member 44 is received on the interior of the tubular opening 42. A longitudinal edge 46 extends along the length of the split tubular member 44 so as to allow the split tubular member 44 to be placed over the tendon 18. The longitudinal edge 46 can be separated from another longitudinal edge (to be described hereinafter) by a distance greater than the diameter of the tendon 18. As such, the tendon 18 can be easily passed through the opening between the longitudinal edges. The split tubular member 44 can then be slidably received on the interior of the tubular opening 42 so as to form a liquid-tight seal between the tendon 18 and the interior of the tubular member 44.

Similarly, a second split tubular member 48 can be affixed onto the tubular extension 40 of the anchor 14. The second split tubular member 48 will also extend over the unsheathed portion of the tendon 18 and will have the end 50 residing over the sheathed portion 52 of the tendon 18. The interior of the second split tubular member 48 is slidably received, in liquid-tight relationship, onto the outer surface of the tubular extension 40. As can be seen, the relatively long lengths of the tubular members 44 and 48 assure that the exposed portions of the tendon 18 are protected from exposure to the exterior elements. The lengths also assure that such protection will continue even though the tendon 18 is tensioned at an opposite end.

Figure 3:
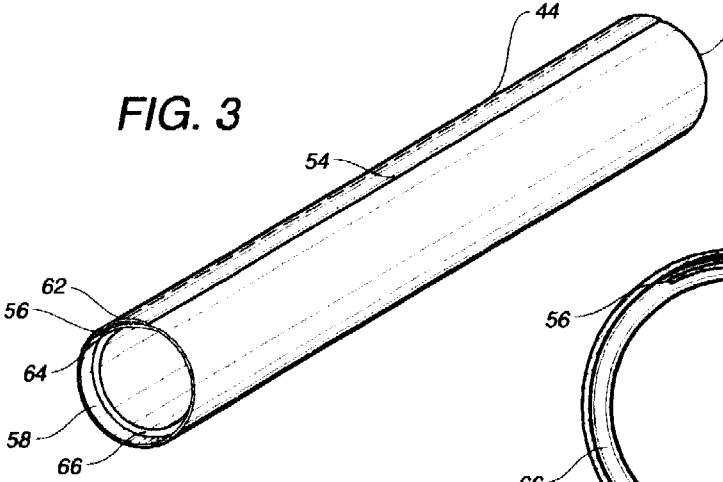
FIG. 3 is an isolated front perspective view of the sealing apparatus of the present invention.

FIG. 3 is an illustration of the tubular member 44 prior to assembly onto the anchor 14. As can be seen, the split tubular member 44 has a first longitudinal edge 54 and a second longitudinal edge 56. Longitudinal edges 54 and 56 are separable by a distance greater than the diameter of the tendon 18 so as to allow the tendon 18 to pass therebetween. The longitudinal edges 54 and 56 extend for the entire length of the tubular member 44 between the first open end 58 and the second open end 60. An insert protrusion 62 is formed on an inner surface of the tubular member 44 adjacent to the longitudinal edge 54. The insert protrusion 62 extends radially inwardly of the tubular member 44. A receptacle 64 is formed on an exterior surface of the tubular member 44 adjacent to the longitudinal edge 56. The receptacle 64 serves to receive the protrusion 62 in liquid-tight relationship. An annular seal 66 is positioned on the interior of the tubular member 44 so as to form a liquid-tight seal with the exterior surface of the sheathed portion of the tendon 18. The tendon 18 will extend through the interior passageway of the tubular member 44.

Figure 4:
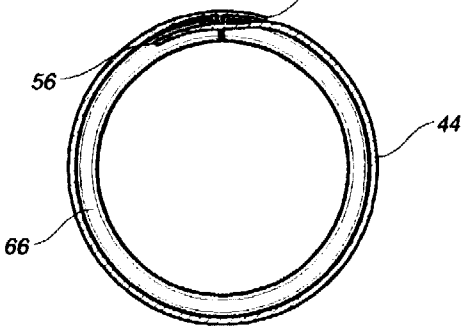
FIG. 4 is an end view of the sealing apparatus of the present invention.

FIG. 4 shows the split tubular member 44 from an end view. As can be seen, the annular seal 66 will extend around the interior surface of the tubular member 44. The first longitudinal edge 54 will reside on the exterior surface of the tubular member 44 and above an exterior surface adjacent the other longitudinal edge 56. The locking and sealing mechanism of the present invention is formed between the longitudinal edges 54 and 56 so as to prevent liquid intrusion therethrough.

Figure 5:
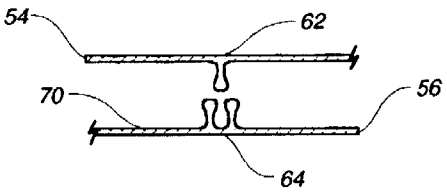
FIG. 5 is an isolated close-up view of the locking apparatus of the present invention.

FIG. 5 shows a detailed view of the locking and sealing mechanism of the present invention. Initially, it can be seen that the insert member 62 extends radially inwardly of the tubular member 44 adjacent to the longitudinal edge 54. Similarly, the receptacle 64 is formed inwardly of the longitudinal edge 56. The receptacle 64 will extend outwardly of the exterior surface 70 of the tubular member 44. The insert protrusion 62 will extend inwardly of the tubular member 44. As can be seen, the insert protrusion 62 can be inserted into the receptacle 64 so as to form a liquid-tight seal. The action of the insert member 62 and the receptacle 64 is similar to the manner of sealing a ZIP-LOCK (TM) bag. Continual pressure can be applied to the top surface of the tubular member 44 adjacent to the insert protrusion 62 so as to assure that the insert protrusion 62 resides within the receptacle 64 along the entire length of the tubular member 44.

Figure 6:
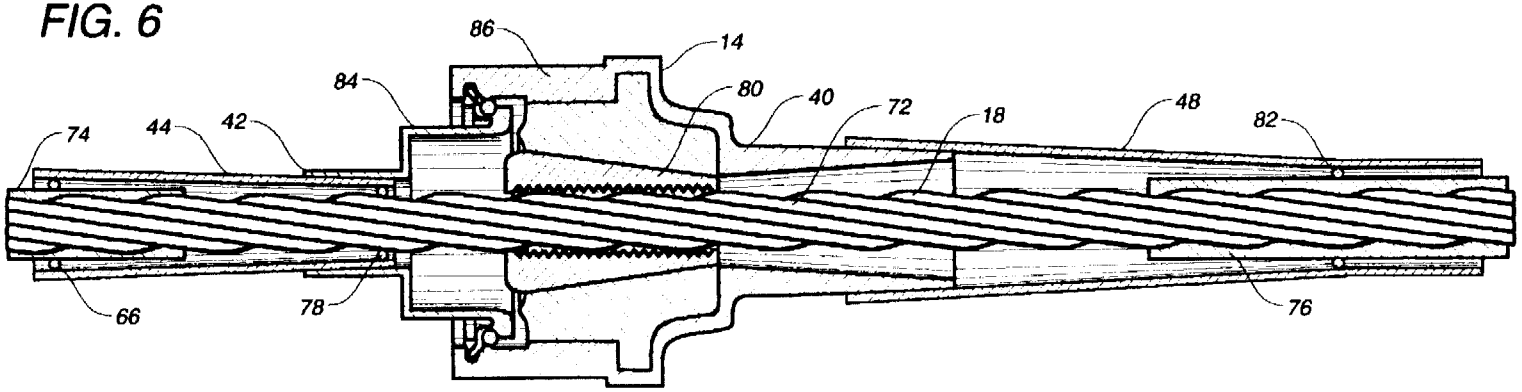
FIG. 6 is a cross-sectional view of the intermediate anchorage system of the present invention.

FIG. 6 shows the manner in which the intermediate anchorage system of the present invention serves to receive the tendon 18 therein. Initially, it can be seen that the tendon 18 has an unsheathed portion 72 and sheathed portions 74 and 76. The first split tubular member 44 is received within the tubular opening 42 of the anchor 14. An annular seal 78 is formed in the end received by the tubular opening 42 so as to form a liquid-tight seal between the unsheathed portion 72 of the tendon 18 and the inner surface of the split tubular member 44. Another annular seal 66 is formed at an opposite end of the tubular member 44 so as to form a liquid-tight seal between the sheathed portion 74 and the inner surface of the tubular member 44. In this manner, liquid intrusion is prevented from passing to the exposed portion of the tendon 18.

It can be seen that the tendon 18 extends through the first split tubular member 44 through the interior passageway 80 of the anchor 14, through the tubular extension 40 of the anchor 14, and through the interior of the second split tubular member 48. The second split tubular member 48 is affixed to an exterior surface of the tubular extension 40 in liquid-tight relationship. An annular seal 82 is positioned on an interior of the second split tubular member 48 so as to form a liquid-tight seal between the interior of the tubular member 48 and an exterior surface of the sheathed portion 76 of tendon 18. A second split tubular member 48 has a configuration similar to that of the first split tubular member 44. As such, it can be easily installed by separating the longitudinal edges so as to allow the tendon to pass between the longitudinal edges. The second split tubular member 48 can then slide onto the exterior surface of the tubular extension 40.

In practice, the first split tubular member 44 can also be installed by first placing the tubular member 44 over the exterior of the tendon 18 and then sliding the tubular member 44 so as to reside interior of the tubular opening 42. It should be noted that, within the concept of the present invention, the tubular member 44 can also reside on an exterior surface of the tubular opening 42. It is possible to install seals into the interior opening 42 so that a direct liquid-tight seal is formed between the interior of the tubular opening 42 and the exterior surface of the tendon 18. It should also be noted that the seal 78 can be eliminated if suitable sealing action is provided between the attachment of the cap 84 and the encapsulation 86 of the anchor 14.

As can be seen in the present invention, the tubular members can be easily installed over the tendon by simply separating the longitudinal edges and then sealing the insert protrusion into the receptacle. This liquid-tight-seal is formed in a simple and easy manner. It is not necessary to tape the exposed areas of the tendon 18 or to carry out other protective measures. It is also not necessary to thread the tubular members along the entire length of the tendon 18 so as to bring them into proximity with the intermediate anchor 14. The tubular members 44 and 48 can be easily manufactured by extrusion or by injection molding.

The foregoing disclosure and description of the invention is illustrative and explanatory thereof. Various changes in the details of the illustrated construction or in the described method can be made within the scope of the appended claims without departing from the true spirit of the invention. The present invention should only be limited by the following claims and their legal equivalents.

I claim:

1. An intermediate anchorage for a post-tension system comprising:

an anchor member having an interior passageway extending therethrough;

a tendon extending through said interior passageway of said anchor, said tendon having a sheathed portion and an unsheathed portion extending outwardly from a first side and a second side of said anchor member;

a first split tubular member having a single split extending longitudinally therealong, said first split tabular member received at one end by said anchor member and extending over said unsheathed portion of said tendon extending outwardly from said first side of said anchor member, said first split tubular member having another end extending over said sheathed portion of said tendon extending outwardly from said first side of said anchor member, said single split of said first split tubular member having a first longitudinal edge and a second longitudinal edge, said first and second longitudinal edges being separable by a distance greater than a diameter of said tendon, said first split tubular member having a sealing means formed adjacent at least one of said longitudinal edges for forming a liguid-tight seal between said longitudinal edges; and a second split tubular member affixed at one end to said second side of said tubular member and extending over the unsheathed portion of said tendon extending outwardly from said second side of said anchor member, said second split tubular member having another end extending over the sheathed portion of said tendon extending outwardly from said second side of said anchor member, said second split tubular member having a single split extending longitudinally therealong, said single split of said second split tubular member having longitudinal edges in overlapping relationship and separable by a distance not less than a diameter of said tendon, said second split tubular member having a sealing means formed adjacent said longitudinal edges for forming a liquid-tight seal between said longitudinal edges of said second split tubular member.

2. The anchorage of claim 1, said anchor member having an opening formed at said one side of said anchor member, said first split tubular member extending into said opening.

3. The anchorage of claim 2, said first split tubular member having a first seal means formed at said end received by said opening, said first seal means for forming a liquid-tight seal between an inner wall of said first split tubular member and an outer surface of said unsheathed portion of said tendon extending outwardly of said first side of said anchor member.

4. The anchorage of claim 3, said first split tubular member having a second seal means formed adjacent said another end for forming a liquid-tight seal between an inner wall of said first split tubular member and an outer surface of said sheathed portion of said tendon extending outwardly of said first side of said anchor member.

5. The anchorage of claim 1, said first longitudinal edge being in overlapping relationship with an exterior surface of said first split tubular member adjacent said second longitudinal edge of said first split tubular member.

6. The anchorage of claim 1, said sealing means comprising:

an insert protrusion extending radially inwardly adjacent one of said first and second longitudinal edges; and a receptacle formed radially outwardly of said exterior surface of said first split tubular member, said insert protrusion received in liquid-tight relationship by said receptacle.

7. The anchorage of claim 6, said insert protrusion and said receptacle extending longitudinally along a substantially entire length of said tubular member.

8. The anchorage of claim 1, said sealing means comprising:

an insert protrusion extending radially outwardly of said exterior of said first split tubular member; and a receptacle formed radially inwardly adjacent one of said first and second longitudinal edges, said insert protrusion being received in liquid-tight relationship by said receptacle.

9. The anchorage of claim 1, said anchor member being an encapsulated anchor having a tubular extension extending outwardly from said second side of said anchor member, said tendon extending through said tubular extension, said one end of said second split tubular member affixed to said tubular extension.

10. The anchorage of claim 9, said another end of said second split tubular member having a sealing member received therein, said sealing member interposed in liquid-tight sealing relationship between an exterior surface of said sheathed portion of said tendon extending outwardly of said second side of said anchor member and said interior surface of said second split tubular member.

11. A method of post-tensioning an intermediate anchorage in a post-tension system comprising the steps of:

extending a tendon through an interior passageway of the intermediate anchorage;

stressing said tendon such that an unsheathed portion of said tendon extends outwardly of one side of said anchorage;

separating longitudinal edges of a split tubular member by a distance greater than a diameter of said tendon;

passing said tendon between the separated longitudinal edges such that said unsheathed portion of said tendon resides on an interior of said tubular member; and sealing an area between said longitudinal edges so as to prevent liquid intrusion into the interior of said tubular member.

12. The method of claim 11, further comprising the step of:

stripping a sheathing from the tendon in an area adjacent said intermediate anchorage so as to form the unsheathed portion.

13. The method of claim 11, said one end of said anchorage having a tubular opening through which said tendon extends, said method further comprising the step of:

sliding the sealed tubular member into said tubular opening such that said tubular member is interposed in liquid-tight relationship between said tubular opening and an exterior surface of said unsheathed portion.

14. The method of claim 11, said step of sealing further comprising:

positioning one end of said tubular member over a sheathed portion of said tendon distal said anchorage; and forming a seal in said tubular member at said one end such that said seal is interposed in liquid-tight relationship between an interior wall of said tubular member and an exterior surface of said sheathed portion.

15. The method of claim 11, said step of sealing comprising:

forming a protrusion on a surface of said split tubular member adjacent one of said longitudinal edges;

forming a receptacle on an exterior surface of said split tubular member adjacent another of said longitudinal edges, said protrusion and said receptacle extending for substantially an entire length of said tubular member; and inserting said protrusion into said receptacle such that said protrusion forms a liquid-tight seal with said receptacle.

16. The method of claim 11, said step of sealing comprising the steps of:

forming a protrusion on an exterior surface of said split tubular member adjacent one of said longitudinal edges;

forming a receptacle on an interior surface of said split tubular member adjacent another of said longitudinal edges; and inserting said protrusion into said receptacle such that said protrusion forms a liquid-tight seal with said receptacle.

17. The method of claim 11, said anchorage having a tubular extension extending outwardly therefrom, said step of sealing comprising the step of:

affixing one end of said sealed split tubular member in liquid-tight relationship onto said tubular extension such that said tubular member extends outwardly therefrom over said unsheathed portion of said tendon, said tubular member having an opposite end residing over a sheathed portion of said tendon.

18. The method of claim 17, further comprising the step of:

forming a sealing member at said opposite end of said tubular member interior of said tubular member, said sealing member being interposed in liquid-tight relationship with an exterior surface of said sheathed portion.

* * * * *